United States Patent [19]

Moshnin et al.

[11] 4,246,772

[45] Jan. 27, 1981

[54] PRESSING BRANCH PIPE ON THICK-WALLED SHELL-DEVICE FOR REALIZATION THEREOF

[76] Inventors: Evgeny N. Moshnin, ulitsa Ak. Pavlova, 50, kv. 5; Nikolai I. Romashko, Sumskoi proezd, 12, korpus 4, kv. 108; Leonid V. Prozorov, Sharikopodshipnikovskaya ulitsa, 2, kv. 39; Nikolai N. Zorev, ulitsa Novinki, 6, kv. 23; Oleg V. Scherba, ulitsa Shturvalnaya, 5, korpus 2, kv. 61; Viktor A. Odnodushny, Stremyanny pereulok, 2/12, kv. 8; Nikolai I. Zhiltsov, Leninsky prospekt, 1, kv. 7; Lev A. Rabinovich, ulitsa Bolotnikovskaya, 40, korpus 3, kv. 13, all of Moscow; Lev V. Tupitsyn, Pushkin, ulitsa I Maya, 27/44, kv. 9, Leningrad; Konstantin P. Alexeev, Kolpino, ultisa Truda, 15/5, kv. 16, Leningrad; Boris P. Kukushkin, Kolpino, ulitsa Lenina, 32, kv. 6, Leningrad; Jury V. Brjukhanov, Kolpino, ulitsa V. Slutskoi, 40, kv. 5, Leningrad; Boris A. Trifonov, Kolpino, ulitsa Proletarskaya, 58, kv. 185, Leningrad; Vyacheslav A. Morozov, Sudostroitelnaya ulitsa, 45, kv. 3; Gennady V. Rudyak, Gruzinsky pereulok, 14, kv. 50, both of Moscow, all of U.S.S.R.; Sergei K. Bakhvalov, deceased, late of Leningrad, U.S.S.R.; Larisa M. Bakhvalova, administrator, Kolpino, prospekt Lenina, 45, kv. 52, Leningrad, U.S.S.R.

[21] Appl. No.: 926,018

[22] Filed: Jul. 19, 1978

[51] Int. Cl.[2] ..... B21D 22/00

[52] U.S. Cl. ..... 72/358; 29/157 A; 72/370

[58] Field of Search ..... 72/356, 357, 369, 370, 72/358, 354; 29/157 A, 157 R

[56] References Cited

U.S. PATENT DOCUMENTS

| | | | |
|---|---|---|---|
| 2,534,185 | 12/1950 | Taylor | 29/157 A |
| 2,675,049 | 4/1954 | Martin | 29/157 A X |
| 2,867,036 | 1/1959 | Hovelmann | 29/471.7 |
| 3,120,400 | 2/1964 | Capenter | 285/137 |
| 3,869,776 | 3/1975 | Moshnin et al. | 29/157 A |
| 4,106,322 | 8/1978 | Moshnin et al. | 29/157 A X |

FOREIGN PATENT DOCUMENTS 1184607 5/1966 Fed. Rep. of Germany .

*Primary Examiner*—Leon Gilden
*Attorney, Agent, or Firm*—Fleit & Jacobson

[57] ABSTRACT

The method consists in flanging the wall of a thick-walled shell around a hole made in said wall in adavance until a branch pipe is produced, in calibrating said shell on the inside surface adjoining the branch pipe, and simultaneous straightening of the thick-walled shell on its outside surface in the direction of the longitudinal axis of the branch pipe from the side opposite to the location of said branch pipe.

The device for the realization of the method according to the invention comprises a flanging die with guide columns secured on it, said columns carrying a cantilevered arbor capable of moving longitudinally and provided with a mechanism for fixing it in the initial position, and pushers fastened on the movable cross-head of a press, and arranged normally to the longitudinal axis of the arbor with which they interact and symmetrically to the longitudinal axis of the flanging punch and there is an additional die located between said pushers, the lower surface of said additional die having a shape corresponding to the shape of the outer surface of the shell while the lower surface of the punch holder has a shape corresponding to the shape of the inside surface of the shell. Besides, the flanging die is provided with projections entering the slots on the faces of the thick-walled shell.

8 Claims, 12 Drawing Figures

PRESSING BRANCH PIPE ON THICK-WALLED SHELL-DEVICE FOR REALIZATION THEREOF

The present invention relates to the methods of pressing branch pipes on thick-walled shells and to the devices for the realization of these methods employed in the power-engineering, petrochemical and other branches of machine building industry.

Most efficiently the present invention will be used for pressing branch pipes on very large thick-walled shells, e.g. on the casing shells of an atomic reactor.

Known in the previous art (see U.S. Pat. No. 2,065,915) is a method of pressing radial branch pipes on hollow cylindrical billets (pipes, shells) wherein the first step is to pierce a hole in the billet wall with simultaneous thickening of the wall around said hole followed by a two-step flanging of the wall around said hole to produce a branch pipe.

This method of pressing branch pipes on shells ensures uniform thickness and sufficient height of the wall.

However, the glanging of the branch pipe distorts the original shape of the shell. The latter becomes barrel-shaped in the zone directly adjoining the formed branch pipe and oval-shaped on the other parts of the surface. Therefore, if it is wanted to produce an article with the requisite accuracy of dimensions, the shell must be additionally straightened on the outside in the direction of the longitudinal axis of the branch pipe and calibrated inside in the zone adjoining the branch pipe. These processes of calibration and straightening of shells call for the employment of additional equipment and operators which in the long run makes the pressing of branch pipes on thick-walled shells considerably more expensive.

Besides, the two-step flanging also involves considerable difficulties in pressing branch pipes on thick-walled large-diameter shells.

Thus, said additional operations and two-step flanging increase sharply the amount of labour in manufacturing the articles and reduce labour efficiency.

A similar process is carried out when pressing non-radial branch pipes, i.e. the branch pipes whose longitudinal axis is not perpendicular to the shell surface.

This method ensures pressing of branch pipes with a uniform thickness of the wall if the face of the branch pipe is set at such an angle to the branch pipe axis which corresponds to the angle of inclination of the longitudinal axis of the branch pipe to the shell surface.

If it becomes necessary to use this method for pressing a non-radial branch pipe with the face perpendicular to its axis, this involves great difficulties in ensuring uniform thickness of the wall around the circumference of the branch pipe.

Besides, as in the case of radial branch pipe, it is necessary to straighten and calibrate the shell on additional equipment which increases the amount of labour required and reduces labour efficiency.

Known in the previous art (see U.S. Pat. No. 3,022,811) is a device for pressing branch pipes on pipes and shells. This device comprises a flanging die secured on the movable cross-head of a press, and an arbor cantilevered on a support fastened on the press bed. Secured by a punch holder to the arbor is a flanging punch whose working portion is directed to the flanging die. A hollow billet is set on the cantilevered arbor and the hole in the billet wall is aligned with the punch, both the arbor with the punch and the punch holder being located inside the shell.

The known device is capable of pressing radial branch pipes on pipes and shells.

However, like the known methods, the known device fails to ensure the required accuracy of shell dimensions while pressing branch pipes on billets.

Accordingly, it becomes necessary to straighten the shells additionally on the outside in the direction of the longitudinal axis of the branch pipe and to calibrate them inside in the zone directly adjoining the branch pipe.

In addition, the size and weight of the arbor rigidly secured on the support in the course of pressing any kind of branch pipes on thick-walled large-diameter shells are so great that they exceed the load-lifting capacity of the movable beds of the existing presses and in a number of cases transportation of the arbor becomes impossible.

Serious difficulties arise in arranging the shells on the arbor, aligning them with the punch and accommodating the device in the die space of the press when it becomes necessary to make branch pipes on thick-walled large-diameter shells.

The main object of the present invention is to provide a method of pressing a branch pipe on a thick-walled shell and a device for the realization thereof which would improve the quality of the pressed products by raising their manufacturing accuracy due to their pressing integral with the shell.

Another no less important object of the invention is to make a branch pipe on a thick-walled shell by heating said shell only once on single-acting presses.

An important object of the invention is to reduce the weight of the device for pressing branch pipes on extra-large thick-walled shells, e.g. on the shells of atomic reactor casings.

And still another object of the invention is to improve the efficiency of the device by carrying out a number of pressing operations within a single stroke of the press cross-head.

These objects are achieved by providing a method of pressing a branch pipe on a thick-walled shell which consists in flanging the wall of the thick-walled shell around a hole made in said wall in advance; then, after flanging and making a branch pipe, the thick-walled shell is calibrated on the inside in the zone adjoining the branch pipe and simultaneously straightened on the outside in the direction of the longitudinal axis of the branch pipe from the side opposite to the location of said branch pipe.

Such operations of this method make it possible to press both radial and non-radial branch pipes on thick-walled shells and to bring distortion of the shell shape to a minimum, which means that the shell has a minimum ovality while in the zone adjoining the branch pipe the thick-walled shell is not barrel-shaped.

It is practicable that the thick-walled shell should be calibrated inside and straightened outside on the circumference of the shell exceeding the outside diameter of the branch pipe base.

This ensures the required accuracy of the shell shape and dimensions with a minimum force for straightening the external surface of the shell and calibrating its zone adjoining the branch pipe.

It is preferable that flanging of the non-radial branch pipe should be carried out concurrently with side thrust applied to the flanging punch from the side of the shorter generatrix of the branch pipe.

Thus it will become possible to press branch pipe non-radially arranged on the thick-walled shell and having faces perpendicular to their longitudinal axis with a uniform thickness of the wall around the circumference of the branch pipe.

This method can be realized by a device for pressing a branch pipe on a thick-walled shell comprising a flanging die and a cantilevered arbor carrying a punch holder and a flanging punch. In the device according to the invention the flanging die is provided with guide columns carrying a cantilevered longitudinally-movable arbor which has a mechanism for fixing it in the initial position on the guide columns, the flanging die being made with fixing projections which interact with the corresponding slots in the faces of a thick-walled shell and there are pushers secured on the movable cross-head, of the press said pushers being arranged normally to the longitudinal axis of the arbor and symmetrically to the longitudinal axis of the flanging punch and interacting with the arbor, said device also comprising an additional movable straightening die mounted on the movable cross-head of the press between the pushers, the lower surface of said additional die corresponding to the shape of the outer surface of the thick-walled shell while the lower surface of the punch holder corresponds in shape to the inner surface of the thick-walled shell.

Such a design of the device ensures the realization of the above-described method of pressing a branch pipe on a thick-walled shell on general-purpose single-acting presses by heating the shell only once and within one stroke of the press cross-head.

This design of the device reduces its weight considerably due to a cantilever-type fastening of the arbor and the possibility of its movement along the columns during pressing of branch pipes on thick-walled large-size shells.

The provision of the arbor fixing mechanism ensures suspension of the arbor with the punch in the topmost position and free insertion of the billet (large shell) into the device outside of the press die space, i.e. with the press bed moved out.

Besides, the provision of fixing projections on the die ensures reliable alignment of the hole axis in the shell wall with the axis of the hole in the flanging die and a higher accuracy of branch pipe dimensions.

It is practicable that the punch holder and the lower surface of the straightening die made to the shape of the external surface of the thick-walled shell should have, respectively, a width exceeding the outside diameter of the branch pipe base and a length equal to the length of the thick-walled shell.

Due to such a design of the punch and straightening die, application of a minimum force ensures guaranteed calibration and straightening of the shell whose shape has been distorted in the course of flanging.

It is practicable that each fixing mechanism should be made in the form of a fixing rod located in a horizontal through channel in the arbor projection and that the free end of said rod should be inserted into a slot in the guide column while its other end should be connected by a hinge to a shorter arm of the two-arm lever secured by another hinge on a bracket rigidly fastened on the arbor; it is practicable that the tip of the free end of the fixing rod should have a chamfer interacting with a slanting platform of the slot in the guide column, and withdrawing the fixing rod from the slot in the guide column on lifting of the arbor.

In this way the arbor is held reliably on the columns in the topmost (initial) position and is released after rising but a little.

It is desirable that the flanging punch should be of a built-up construction consisting of a post secured on the arbor by means of the punch holder, and of a working portion whose central extension enters freely a hole oriented along the longitudinal axis of the post and is fixed therein by a removable bar.

The built-up construction of the flanging punch allows its working portion to be disengaged from the post under its own weight and thus provides for free return of the arbor with the punch post to the initial position after completion of branch pipe pressing.

It is practicable that the free end of the arbor should be provided with a stop constacting another stop made on the flanging die over the vertical surface which is parallel to the longitudinal axis of the flanging punch and oriented towards the longitudinal axis of the arbor.

In this case the side thrust is taken up and the punch is not displaced from the preset direction while pressing a non-radial branch pipe so that the branch pipe wall has a uniform thickness.

It is desirable that the stop on the flanging die should be installed with a provision for turning around a horizontal axis which is parallel to the longitudinal axis of the arbor.

This will facilitate insertion of a thick-walled shell into the device because there appears a required clearance between the arbor stop and the flanging die.

It is preferable that the tapered section of the working portion of the flanging punch should be truncated with the angle of its generatrix to the longitudinal axis of the punch varying from 15° to 30°, the height of the truncated tapered section ranging from 0.35 to 0.5 of the diameter of the cylindrical calibrating band and that this section should be supplemented by a tapered surface whose longitudinal axis is parallel to the longitudinal axis of the flanging punch and the angle of inclination of said tapered surface to the longitudinal axis of the flanging punch is $$\phi_2=(\pi/2)-m(\pi/2-\alpha)$$

where $\alpha$ = angle of inclination of the branch pipe axis to the surface of the thick-walled shell;

m = coefficient varying from 1.8 to 2.2.

This will enable pressing a non-radial branch pipe with its face perpendicular to its axis and with minimum wall variations around its circumference.

The pushers can be provided with replaceable stops mounte with a provision for horizontal movement in the direction perpendicular to the longitudinal axis of the arbor.

This will make it possible to press the branch pipe on the thick-walled shell of a large diameter by heating it only once and within two strokes of the press movable cross-head if the maximum height of the press die space is limited and denies the possibility of pressing within one stroke.

Now the invention will be described in detail by way of examples of the method of pressing branch pipes on thick-walled shells and of the device for the realization thereof with reference to the accompanying drawings, in which.

The method according to the invention is put in effect as follows.

Figure 2:
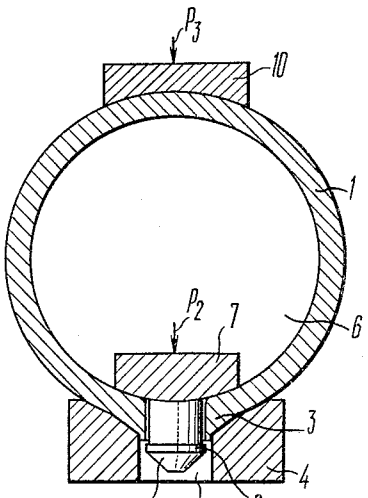
FIG. 2 shows the same thick-walled shell and the flanging die during calibration of the inside surface of the shell, the straightening die during straightening of the outside surface of shell and the flanging punch in the position of completing the flanging of a radial branch pipe.
Figure 1:
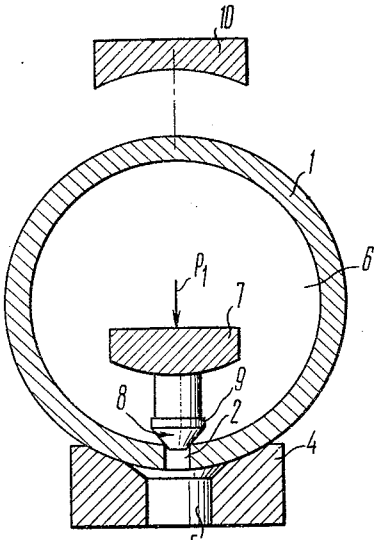
FIG. 1 is a schematic representation of the thick-walled shell, the flanging and straightening dies and the flanging punch before the beginning of flanging.

A thick-walled shell 1 (FIG. 1) with a hole 2 in the side wall for flanging a branch pipe 3 (FIG. 2) is heated to the pressing temperature and placed on a flanging die 4 (FIG. 1), aligning the hole 2 coaxially with the hole 5 made in the flanging die 4 and intended to accommodate the branch pipe 3 (FIG. 2).

The branch pipe 3 is flanged by inserting an arbor 7 with a flanging punch 8 into the space 6 of the thick-walled shell 1 (FIG. 1) and said punch 8 is set coaxially with said holes 2 and 5. Then the arbor 7 is subjected to a flanging force $P_1$ which is transmitted to the flanging punch 8 which flanges a portion of the wall around the hole 2 to form a branch pipe 3 (FIG. 2). This flanging can be carried out either with or without forced thinning-out of the wall around the hole 2 in the thick-walled shell 1.

At the final stage of flanging, before the calibrating cylindrical band 9 (FIG. 2) of the punch 8 moves out of the branch pipe 3, the inner surface of the thick-walled shell 1 at the point where it adjoins the branch pipe 3 is calibrated by the arbor 7 with a force $P_2$.

This eliminates the convexity (barrel shape) of the thick-walled shell 1 arising in the course of pressing in the zone adjoining the branch pipe 3.

Simultaneously, the thick-walled shell 1 is straightened on the outside at the side opposite to the location of said branch pipe 3. For this purpose a force $P_3$ is impressed on the additional die 10 and the thick-walled shell 1 is straightened in the direction of the longitudinal axis of the branch pipe 3.

This minimizes the ovality of the thick-walled shell 1 occurring in the course of pressing of the branch pipe 3.

Said calibration of the internal surface and straightening of the external surface of the thick-walled shell 1 are carried out in the zones, each of which is equal to the length of the arc of the circumference of the thick-walled shell 1 exceeding the outside diameter of the base of the branch pipe 3.

Figure 3:
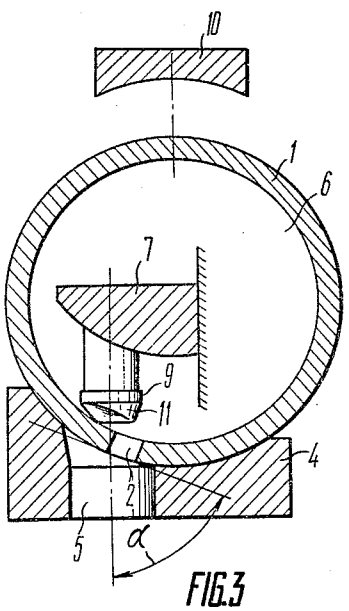
FIG. 3 shows schematically the thick-walled shell, the flanging and straightening dies and the flanging punch before pressing a non-radial branch pipe.

A similar procedure is followed in pressing a non-radial branch pipe (not shown in the drawing) with the aid of the flanging punch 11 (FIG. 3). In this case the longitudinal axis of the flanging punch 11 and the longitudinal axis passing through the centre of the hole 5 in the flanging die 4 are set at an angle to the surface of the thick-walled shell 1, said angle being equal to angle $\alpha$ at which the longitudinal axis of the branch pipe is inclined to the surface of the thick-walled shell 1. The non-radial branch pipe is flanged with simultaneous side thrust applied to the flanging punch 11 from the side of the shorter generatrix of the branch pipe. The provision of the side thrust eliminates the displacement of the flanging punch 11 towards the shorter generatrix of the branch pipe under the effect of the side force acting on the flanging punch in the course of flanging from the side of the longer generatrix of the branch pipe, thereby ensuring uniform thickness of the walls around the circumference of the branch pipe.

Figure 4:
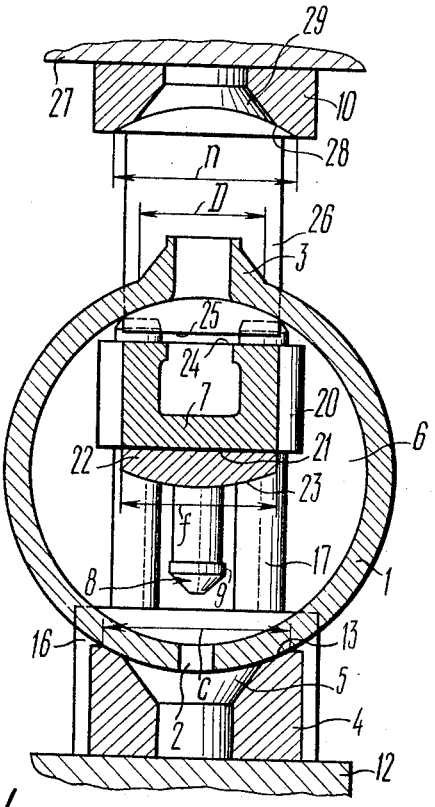
FIG. 4 shows the device for pressing a radial branch pipe on a thick-walled shell with the flanging punch in the initial position, intersection by a vertical plane along the longitudinal axis of the flanging punch and across the thick-walled shell.
Figure 10:
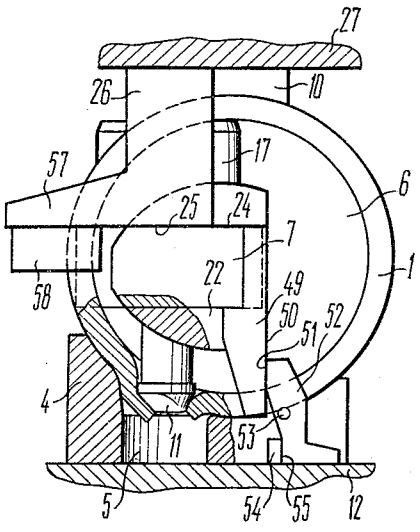
FIG. 10 shows a device for pressing a non-radial branch pipe with the flanging punch shown in the intermediate position, a partial section along the punch and across the shell, with cutouts.

The device for pressing a radial branch pipe 3 (FIGS. 6 and 7) on the thick-walled shell 1 (FIGS. 4, 5) around the hole 2 has a flanging die 4 with a hole 5 for the branch pipe 3 and an arbor 7 inserted into the space 6 (FIG. 4) of the thick-walled shell 1, said arbor carrying a punch 8 which has a calibrating cylindrical band 9. The device has an additional straightening die 10 for acting on the thick-walled shell from above and may have a non-radial flanging punch 11 (FIG. 10) whose design will be described in detail in the following example.

The flanging die 4 (FIG. 4) is installed on the pull-out bed 12 of the press and has a recess in the upper part to receive the thick-walled shell 1. The surface of said recess 13 in the transverse direction has a radius of curvature corresponding to the radius of curvature of the external surface of the thick-walled shell 1.

The width (c) of the recess 13 exceeds the outside diameter (D) of the base of the branch pipe 3 in the thick-walled shell 1 and allows the latter to be freely accommodated on the flanging die 4.

The shape and dimensions of the hole 5 in the flanging die 4 make it possible to obtain the corresponding shape and dimensions of the branch pipe 3 on the thick-walled shell 1. The flanging die 4 has projections 14 (FIG. 5) entering, each, into the corresponding slot 15 on the opposite face of the thick-walled shell 1. These projections 14 are located in the longitudinal plane of symmetry of the recess 13 and hole 5. The slots 15 are coaxial to each other and their axis of symmetry passes through the centre of the hole 2 in the thick-walled shell 1 opposite the hole 5 in the flanging die 4.

A projection 16 on the flanging die 4 beyond the limits of the recess 13 carries the vertical guide columns 17 with a cantilevered arbor 7.

The arbor 7 is mounted on the guide columns 17 with the aid of guide bushings 18 accommodated in vertical through channels 19 located in the projection 20 of the arbor 7. Owing to such a joint the cantilevered arbor 7 (FIGS. 6 and 7) can be moved vertically along the guide columns 17, for example upward by a crane (not shown in the drawings) to a position in which the thick-walled shell 1 can be placed on the flanging die 4 in which case the arbor enters the space 6 of said shell.

The length of the arbor 7 is sufficient for its end to move beyond the limits of the thick-walled shell 1. Secured by means of the punch holder 22 on the lower surface 21 (FIG. 4) of the arbor 7 is the flanging punch 8 arranged coaxially with the hole 5 in the flanging die 4.

The shape of the lower surface 23 of the punch holder 22 corresponds to the shape of the inner surface of the thick-walled shell 1, the width (f) of the punch holder 22 exceeding the outside diameter (D) of the base of the branch pipe 3 in the thick-walled shell 1 while the length (b) (FIG. 5) of the punch holder 22 is equal to or larger than the length (l) of the thick-walled shell 1.

The upper surface 24 of the cantilevered arbor 7 interacts with the bearing surfaces 25 of the pushers 26 secured on the movable cross-head 27 (FIG. 7) of the press (not shown in the drawing) and arranged normally to the longitudinal axis of the arbor 7 and symmetrically to the longitudinal axis of the flanging punch 8.

The device has an additional movable straightening die 10 (FIG. 5) fastened to the movable cross-head 27 of the press between the pushers 26.

The straightening die 10 has a recess 28 at the bottom (FIG. 4) directed towards the thick-walled shell 1. The surface of said recess 28 in the transverse direction has a radius of curvature corresponding to that of the external surface of the thick-walled shell 1.

The width (n) of the recess 28 exceeds the outside diameter (D) of the base of the branch pipe 3 while the length (L) (FIG. 5) is larger than the length (l) of the thick-walled shell 1. The hole 29 in the straightening die 10 is of such a shape and size as to accommodate freely the branch pipe 3.

The arbor 7 is fixed in the initial upper position by two fixing mechanisms 30 (FIG. 8) mounted, each, on the projection 20 of the arbor 7. Said mechanism has a fixing rod 31 located in the horizontal through channel 32 made in the wall of the hollow projection 20 of the arbor 7. The free end 33 of the fixing rod 31 enters the slot 34 in the column 17 and its lower part rests on the supporting surface 35 of the slot 34 thus preventing the arbor 7 (FIG. 5) from going down under its own weight.

The other end of the fixing rod 31 (FIG. 8) is connected by a hinge 36 with the shorter arm of the two-arm lever 37 which is secured by another hinge 38 on the bracket 39 rigidly fastened to the hollow projection 20 of the arbor 7.

Figure 5:
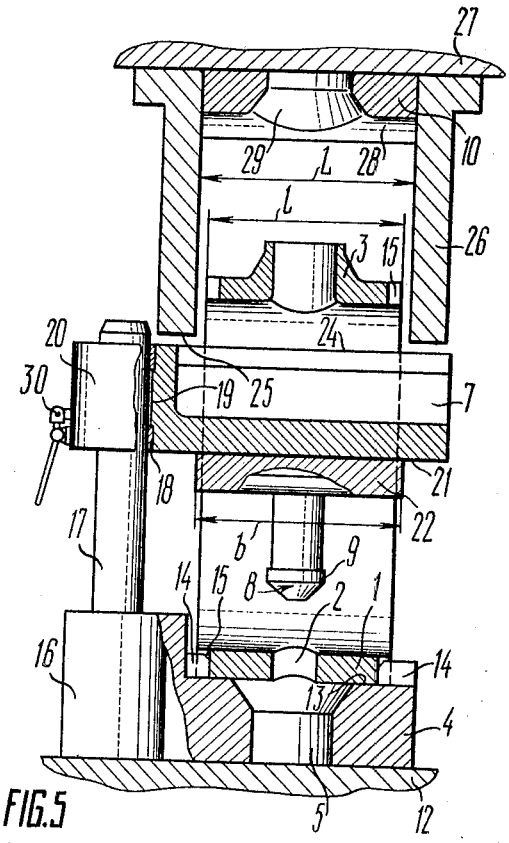
FIG. 5 shows the same device with cutouts, a section along the shell by a vertical plane passing through the longitudinal axis of the flanging punch.
Figure 6:
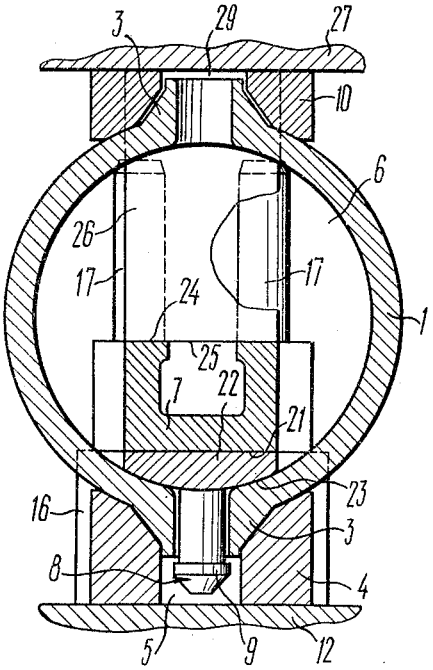
FIG. 6 shows the same device with the flanging punch in the position of completing the pressing operation, a section similar to that in FIG. 4, with a cutout.

The longer arm of the two-arm lever 37 is intended to turn the lever 37 relative to the hinge 38 and to fix the arbor 7 in the initial position on the columns 17 (FIG. 5).

The tip of the free end 33 (FIG. 8) of the rod 31 has a chamfer 40 interacting with a slanting platform 41 of the slot 34 in the column 17. Such a design of the rod 31 and slot 34 ensures automatic release of the arbor 7 when it rises above its initial position.

Figure 9:
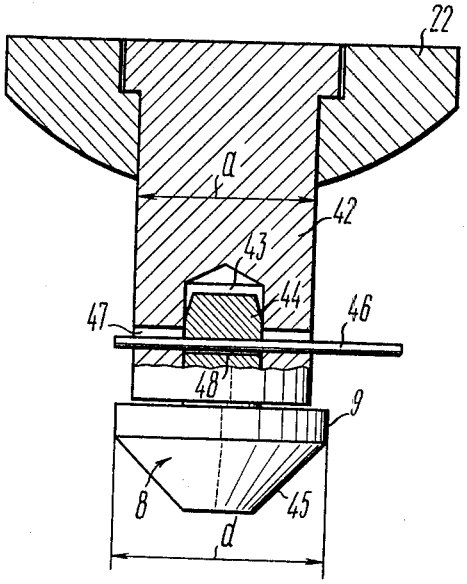
FIG. 9 is a partial section along the longitudinal axis of the built-up flanging punch for pressing a radial branch pipe with a cutout, enlarged.

The flanging punch 8 (FIG. 9) is built up of a working portion and a cylindrical post 42 whose diameter (a) is a little smaller than the diameter (d) of the cylindrical calibrating band 9 of the working portion of the flanging punch 8 and which can be made integral with the punch holder 22.

Located on the lower part of the post 42 along its longitudinal axis is a hollow 43 which receives the extension 44 of the flanging punch 8. The flanging punch 8 has a tapered portion 45 and a cylindrical calibrating band 9 whose diameter is equal to that of the hole of the branch pipe 3.

The flanging punch 8 is connected with the post 42 by a bar 46 passing through the through hole 47 made level with the hollow 43 and arranged across the post 42, coaxially with the through transverse hole 48 in the extension 44.

Figure 7:
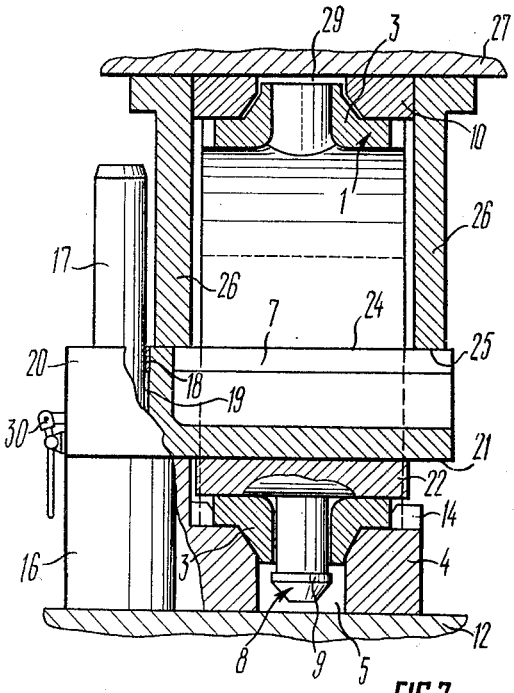
FIG. 7 shows the same device in the position of completing the pressing operation, a section similar to that in FIG. 5 with cutouts.

This layout of the flanging punch 8 ensures free rising of the arbor 7 (FIG. 5) to the initial position after pressing the branch pipe 3 (FIG. 7). Due to such a design the flanging punch 8 can be detached from the post 42 (FIG. 9) and offer no resistance to lifting of the arbor 7 (FIG. 5).

The device for pressing a branch pipe on a thick-walled shell functions as follows.

In the initial position the flanging die 4 (FIGS. 4 and 5) with the columns 17 and arbor 7 carrying the punch holder 22 and the flanging punch 8 are moved out of the die space of the press.

Figure 8:
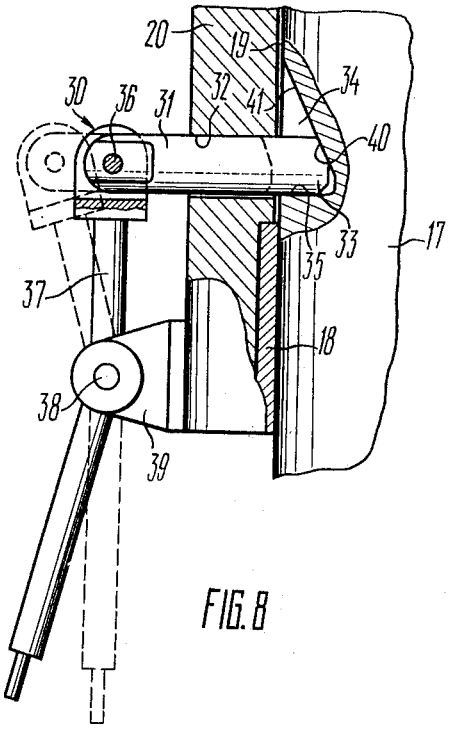
FIG. 8 is a side view of the mechanism for fixing the arbor on the column, with partial sections along a vertical plane and with cutouts, enlarged.

Meanwhile the flanging die 4 and the arbor 7 are located on the pull-out bed 12 of the press so that the longitudinal axis of the arbor 7 is perpendicular to the direction of movement of the bed 12. The arbor 7 with the punch holder 22 and the flanging punch 8 are lifted to the topmost position and locked on the columns 17 by the fixing devices 30 (FIG. 8). The pushers 26 (FIG. 5) and the straightening die 10 fastened on the movable cross-head 27 of the press are also lifted to the topmost position.

The thick-walled shell 1 heated to the pressing temperature is brought to the press by a hoisting mechanism (not shown in the drawing) and placed on the flanging die 4 so that its projections 14 enter the slots 15 on the faces of the thick-walled shell 1.

This ensures axial alignment of the hole 2 in the thick-walled shell 1 with the hole 5 in the flanging die 4. Besides, the arbor 7 is located inside the space 6 of the thick-walled shell 1 so that the longitudinal axis of the flanging punch 8 passes through the centres of the holes 2 and 5 made, respectively, in the thick-walled shell 1 and the flanging die 4 and there is a certain clearance between the lower face of the flanging punch 8 and the inner surface of the thick-walled shell 1.

Then the arbor 7 is lifted by the above-mentioned hoisting mechanism and the chamfer 40 of the rod 31 (FIG. 8) of the fixing device 30 slides over the slanting platform 41 of the slot 34 in the column 17, comes out of the slot 34 and the two-arm lever 37 turns around the hinge 38 of the bracket 39.

Thus, the arbor 7 (FIG. 5) and the columns 17 are released. Then the arbor 7 is lowered to the position in which the tapered portion 45 (FIG. 9) of the flanging punch 8 comes to bear against the edge of the wall around the hole 2 (FIG. 4) in the thick-walled shell 1. The flanging punch 8 (FIG. 9) hanging on the bar 46 passed through the holes 47 in the post 42 and 48 and in the extension 44 and bearing, as stated above, against the edge of the wall, is pressed by the upper surface of the cylindrical band 9 against the lower face of the post 42 and releases the bar 46 which is then removed from the post 42 and extension 44 of the flanging punch 8.

Then the pull-out bed 12 (FIG. 5) of the press with the flanging die 4 and the thick-walled shell 1 installed on said die are moved into the die space of the press and the thick-walled shell is placed between the pushers 26 so that the supporting surface 24 of the arbor 7 is located under the lower surfaces 25 of said pushers.

As the movable cross-head 27 (FIGS. 6 and 7) of the press goes down, the lower surfaces 25 of the pushers 26 act on the supporting surface 24 of the arbor 7 and transmit the force of the press to the flanging punch 8 which flanges the edge of the hole 2 in the wall of the thick-walled shell 1, i.e. forms a branch pipe 3 in the hole 5 of the flanging die 4.

The branch pipe 3 can be flanged either when the wall of the thick-walled shell 1 is thinned out in the case when the clearance between the surface of the cylindrical calibrating band 9 of the flanging punch 8 and the surface 5 in the flanging die 4 is larger than the thickness of the shell wall or with forced thinning-out of said wall when said clearance is substantially smaller than the thickness of the shell wall.

Flanging of the branch pipe 3 (FIGS. 6 and 7) is completed at the moment when the cylindrical calibrating band 9 of the flanging punch 8 comes entirely out of the formed branch pipe 3. Inasmuch as the flanging punch 8 is longer held by anything in the post 42 (FIG. 9), it descends on the press bed 12 (FIG. 7). At this moment the punch holder 22 whose lower surface 23 (FIG. 6) has the same shape and size as those of the inner surface of the thick-walled shell 1 comes in contact with said inner surface and calibrates the zone directly adjoining the branch pipe 3 because said zone has acquired a barrel shape in the course of the flanging operation.

Simultaneously, the additional straightening die 10 whose radius of curvature in the transverse direction corresponds to the radius of curvature of the outer surface of the thick-walled shell 1 comes in contact with said outer surface of the shell 1.

This contact results is straightening of the thick-walled shell 1 along the diameter in the direction of the longitudinal axis of the branch pipe 3 and, consequently, in eliminating the ovality of the thick-walled shell 1 that has arisen in the course of flanging of the branch pipe 3.

To reduce the applied force, the width of the calibrated and straightened portion of the thick-walled shell 1 is somewhat larger than the outside diameter of the base of the branch pipe 3.

This completes the process of pressing the branch pipe 3 on the thick-walled shell 1. The pull-out bed 12 of the press with the flanging die 4 which carries the thick-walled shell 1 moves out of the die space of the press.

The arbor 7 with the punch holder 22 and the punch post 42 (FIG. 9) is lifted by a hoisting mechanism to the topmost position and, on turning of the two-arm lever 37 (FIG. 8) of the fixing device 30, is fixed on the columns 17. The thick-walled shell 1 (FIG. 4) with the flanged branch pipe 3 is withdrawn from the flanging die 4. The flanging punch 8 remaining in the hole 5 of the flanging die 4 is lifted, its extension 44 (FIG. 8) is inserted into the central hole 43 of the post 42 and locked by the bar 46. The device is ready for pressing the next branch pipe.

Figure 11:
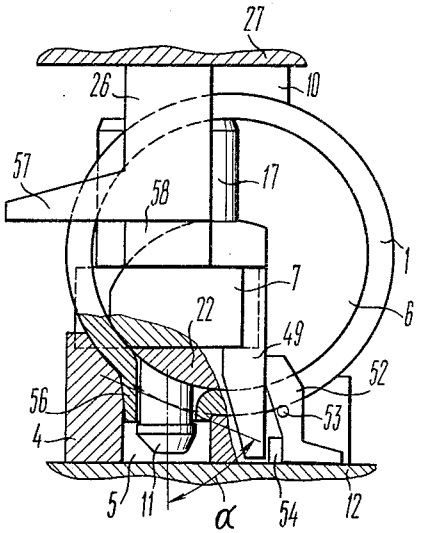
FIG. 11 shows the same device as in FIG. 10 with a section and cutout, the moment of finishing the pressing of the branch pipe.

In another version of the device for pressing a non-radial branch pipe 56 (FIG. 11) the free end of the cantilevered arbor 7 (FIG. 10) is provide with a rigidly-secured stop 49 whose vertical surface 50 interacts with the surface 51 of another stop 52 installed on the flanging die 4, the surface 50 of the stop 49 and the surface 51 of the stop 52 being parallel to the axis of the punch 11 and oriented along the longitudinal axis of the arbor 7. The stop 52 of the flanging die 4 is installed on a horizontal axle 53 secured in the flanging die 4 whereas the stop 52 is capable of turning in the plane perpendicular to the longitudinal axis of the arbor 7. The flanging die 4 has a supporting projection 54 whose side surface 55 supports the turning stop 52.

This layout of the device ensures application of the side thrust arising during flanging of a non-radial branch pipe 56 and prevents the flanging punch 11 from shifting towards the shorter generatrix of the non-radial branch pipe 56. The ability of the stop 52 to turn facilitates the insertion of the thick-walled shell 1 into the device and its installation on the flanging die 4.

The pushers 26 are provided with rigidly secured brackets 57 which carry replaceable stops 58, the latter being able to move horizontally in the direction perpendicular to the longitudinal axis of the arbor 7. The replaceable stops 58 make it possible to flange radial branch pipes 3 (FIG. 6) and non-radial branch pipes 56 (FIG. 11) on thick-walled shells 1 of large diameters if the height of the press die space is limited.

Figure 12:
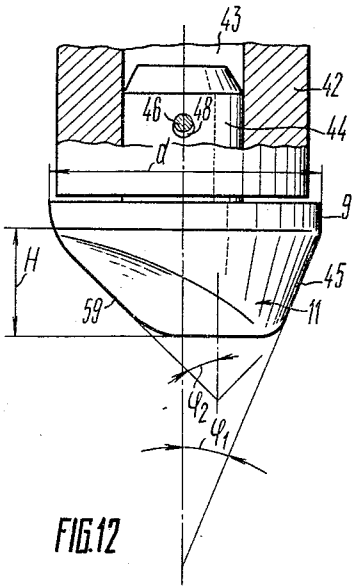
FIG. 12 shows the built-up flanging punch for pressing a non-radial branch pipe on a thick-walled shell with a partial section and cutout, enlarged.

The flanging punch 11 (FIG. 12) for pressing non-radial branch pipes 56 (FIG. 11) has a tapered portion 45 (FIG. 12) whose generatrix is inclined to the longitudinal axis of the cylindrical calibrating band 9 at an angle ($\phi_1$) varying from 15° to 30°. The height of the truncated tapered portion of the working part of the flanging punch 8 is from 0.35 to 0.5 of the diameter (d) of the cylindrical calibrating band 9. The truncated tapered portion 45 is supplemented by a tapered portion 59 whose longitudinal axis is parallel to the longitudinal axis of the cylindrical calibrating band 9 and whose generatrix is inclined to the longitudinal axis of the cylindrical calibrating band 9 at an angle ($\phi_2$) equal to $$\phi_2=(\pi/2)-m(\pi/2-\alpha)$$

where $\alpha$ = angle of inclination of the longitudinal axis of the branch pipe to the surface of the thick-walled shell;

m = coefficient varying from 1.8 to 2.2.

Such a design of the flanging punch 11 ensures flanging of a non-radial branch pipe 56 (FIG. 11) with a face perpendicular to its longitudinal axis and with minimum wall variations on the edge of said branch pipe.

The second version of the device functions in the main similarly to the device described in the first example.

The points of difference are as follows.

In the initial position, before the thick-walled shell 1 is placed on the flanging die 4, the stop 52 is turned around the axle 53 until its supporting surface 51 becomes horizontal and the replaceable stops 58 (FIG. 10) of the pushers 26 are shifted to the extreme left position on the brackets 57.

After placing the thick-walled shell 1 on the flanging die 4 the stop 52 is turned so that its surface 51 becomes vertical, the arbor 7 is released and lowered to a position in which the punch 11 touches the edge of the wall of the thick-walled shell 1 around the hole 2. After the movement of the pull-out bed 12 of the press with the flanging die 4 and thick-walled shell 1, the branch pipe is pressed within two strokes of the press cross-head 27.

During the first stroke of the cross-head 27 the bearing surfaces 25 of the pushers 26 act on the upper surface 24 of the arbor 7 and perform the first stage of flanging of the branch pipe 56 within the limits of the travel of the cross-head 27 which depends on the height of the press die space. At the end of the first flanging stage the straightening die 10 straightens the thick-walled shell 1 along the diameter.

For final flanging of the non-radial branch pipe 56 the movable cross-head 27 is lifted from the intermediate to the topmost position. The arbor 7 with the punch 11 remains in the intermediate position while between the bearing surfaces 25 of the pushers 26 and the upper surface 24 of the arbor 7 there appears a clearance which is larger than the height of the replaceable stops 58.

The replaceable stops 58 (FIG. 11) are moved over the brackets 57 of the pushers 26 to the extreme right-hand position after which the movable cross-head 27 of the press executes the second stroke. The bearing surfaces of the replaceable stops 58 act on the arbor 7 and execute final flanging of the branch pipe 56.

Within the entire process of flanging a non-radial branch pipe 56 the bearing surface 50 of the stop 49 located on the free end of the arbor 7 interacts with the bearing surface 51 of the stop 52 installed on the flanging die 4.

This rules out the displacement of the arbor 7 and punch 11 towards the shorter generatrix of the branch pipe 56 under the effect of the side thrust acting from the side of the longer generatrix of the branch pipe 56. Such a design of the device ensures flanging of a non-radial branch pipe 56 with minimum wall variations along its edge.

Just as in the first example of the device, after flanging the branch pipe 56 the punch holder 22 calibrates the inner surface of the shell 11 where it adjoins the branch pipe 56 and the straightening die 10 straightens the thick-walled shell 1 along the diameter.

Thus, the device according to the invention is adapted for pressing both radial and non-radial branch pipes on thick-walled shells of large diameters on general purpose single-acting presses by heating the shell 1 only once and pressing the branch pipe within one or two strokes of the press cross-head 27. At the same time the device ensures high accuracy of shell dimensions since pressing of the branch pipe 3 (FIG. 6) or 56 (FIG. 11) is followed by simultaneous calibration and straightening of the thick-walled shell 1 with the aid of the device according to the invention.

We claim:

1. A device for pressing a branch pipe on a thick-walled shell located between the upper and lower cross-heads of a press comprising a flanging die with projections for interaction with the corresponding slots on the faces of said thick-walled shell and for fixing the latter in the required position on said flanging die; guide columns secured on said flanging die; an arbor cantilevered on said guide columns with a provision for longitudinal movement relative to these columns; fixing devices, each mounted on said arbor and interacting with said guide column for fixing said arbor on said column; a punch holder secured on said arbor and having a lower surface whose shape corresponds to the shape of the inner surface of said thick-walled shell; a flanging punch secured on said punch holder; pushers secured on said upper movable cross-head of the press and arranged symmetrically to the longitudinal axis of said flanging punch and normally to the longitudinal axis of said arbor with which they interact; an additional movable straightening die secured on said upper movable cross-head of the press between said pushers and having a lower surface whose shape corresponds to the shape of the external surface of said thick-walled shell.

2. A device according to claim 1 wherein the width of said punch holder and of the lower surface of said straightening die following the shape of the external surface of said thick-walled shell exceeds the outside diameter of the branch pipe base and their length exceeds the length of said thick-walled shell.

3. A device according to claim 1 wherein each of said devices for fixing said arbor in the initial position on said guide columns is made in the form of a fixing rod accommodated in a through horizontal channel in the projection of said arbor, the free end of said rod enters the slot in said guide column while its other end is connected by a hinge with the shorter arm of a two-arm lever secured by another hinge on a bracket rigidly fastened to said arbor, the tip of the free end of said fixing rod having a chamfer which interacts with a slanting platform of said slot which is made in said guide column and, during lifting of said arbor, withdraws said fixing rod from said slot in said guide column.

4. A device according to claim 1 wherein said flanging punch is of a built-up construction and comprises a post secured on said arbor with the aid of said punch holder, and a working portion provided with a central extension which enters freely a hole directed along the longitudinal axis of said post and is fixed therein by a removable bar.

5. A device according to claim 1 wherein the free end of said arbor has a stop contacting another stop on said flanging die along a vertical surface which is parallel to the longitudinal axis of said flanging punch and oriented along the longitudinal axis of said arbor.

6. A device according to claim 5 wherein said stop on said flanging die is capable of turning around the horizontal axis which is parallel to the longitudinal axis of said arbor.

7. A device according to claim 4 wherein the tapered portion of said flanging punch is truncated so that its generatrix is inclined to the axis of said flanging punch at an angle of 15° to 30°, the height of said truncated tapered portion varying from 0.35 to 0.50 of the diameter of the cylindrical calibrating band and is supplemented by a tapered surface whose longitudinal axis is parallel to the longitudinal axis of the flanging punch and the angle of inclination of the generatrix of said tapered surface to the longitudinal axis of said flanging punch is $$\phi_2=(\pi/2)-m(\pi/2-\alpha)$$

where $\alpha$ = angle of inclination of the longitudinal axis of the branch pipe to the surface of the thick-walled shell;

m = coefficient varying from 1.8 to 2.2.

8. A device according to claim 1 wherein said pushers are provided with replaceable stops mounted with a provision for moving horizontally in the direction perpendicular to the longitudinal axis of said arbor.

* * * * *